United States Patent [19]

Aguet

[11] Patent Number: 4,462,206

[45] Date of Patent: Jul. 31, 1984

[54] GAS TURBINE-STEAM POWER PLANT

[75] Inventor: Emile Aguet, Winterthur, Switzerland

[73] Assignee: Sulzer Brothers Limited, Winterthur, Switzerland

[21] Appl. No.: 379,138

[22] Filed: May 17, 1982

[30] Foreign Application Priority Data

Jun. 10, 1981 [CH] Switzerland ..... 3791/81

[51] Int. Cl.³ ..... F02C 3/26

[52] U.S. Cl. ..... 60/39.182; 60/39.464

[58] Field of Search ..... 60/39.12, 39.181, 39.182, 60/39.464, 39.511; 122/4 D

[56] References Cited

U.S. PATENT DOCUMENTS 4,086,758 5/1978 Harboe ..... 60/39.182
4,099,374 7/1978 Foster-Pegg ..... 60/39.12
4,116,005 9/1978 Willyoung ..... 60/39.181
4,253,300 3/1981 Willyoung ..... 60/39.182

FOREIGN PATENT DOCUMENTS 2076062 11/1981 United Kingdom ..... 60/39.182

*Primary Examiner*—Louis J. Casaregola
*Attorney, Agent, or Firm*—Kenyon & Kenyon

[57] ABSTRACT

The pressure vessel of the gas turbine-steam power plant is provided with a recuperator and a heat exchanger in order to reduce the temperature of the hot flue gas before separating out gas-entrained particles. The dust separator is connected to the recuperator on a secondary side so that the hot gas can be reheated for delivery to the gas turbine. By cooling the flue gas before entering the separator, use can be made of electrostatic dust filters or cloth filters.

12 Claims, 2 Drawing Figures

GAS TURBINE-STEAM POWER PLANT

Figure 1:
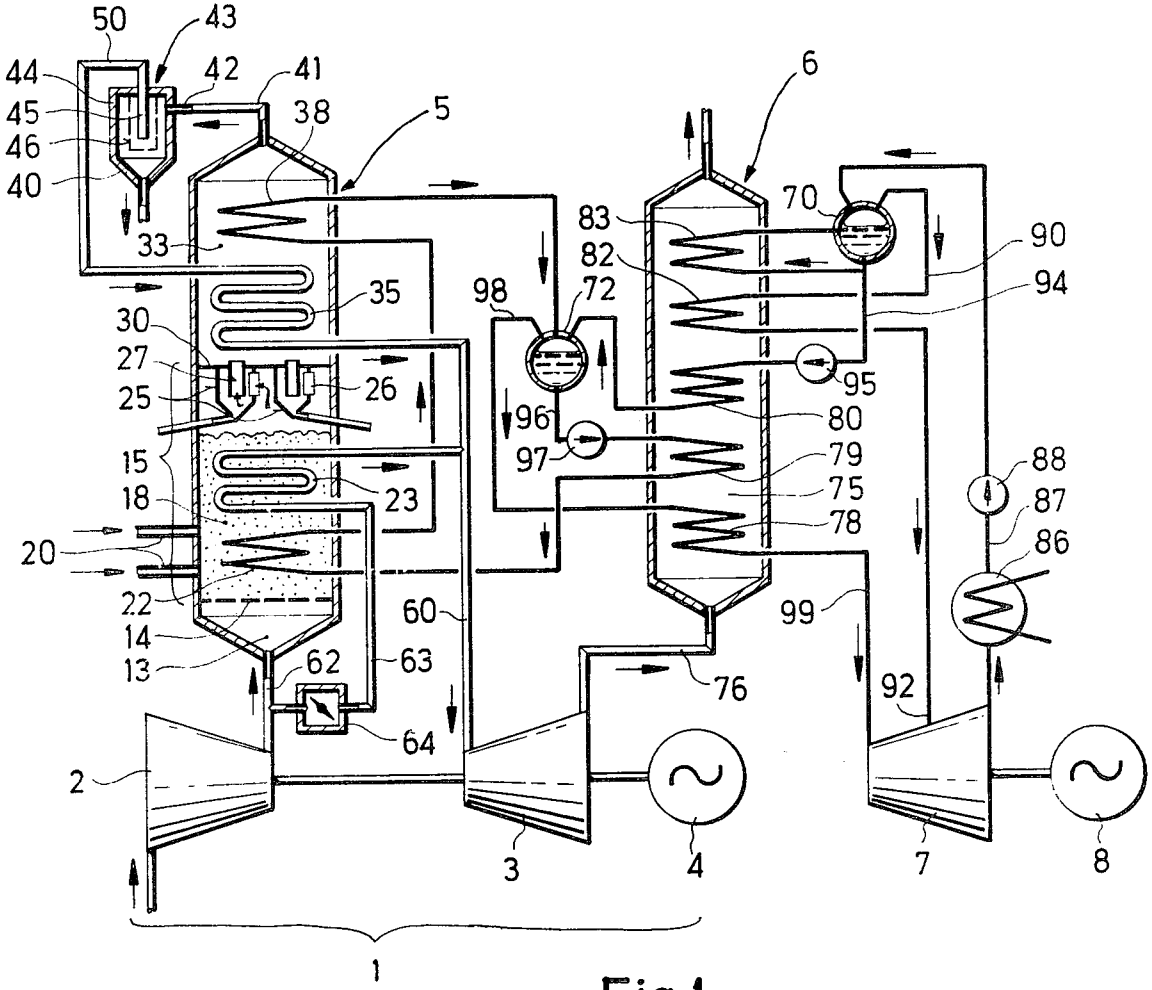

This invention relates to a gas turbine-steam power plant. More particularly, this invention relates to a gas turbine-steam power plant utilizing a fluidized bed combustion chamber.

Heretofore, various types of gas turbine-steam power plants have been known. For example, in one known case, such a plant has been constructed with a pressure vessel in which a fluidized bed of fuel is formed within a combustion chamber. In such a construction, particles from the fluidized bed may become suspended in the resultant flue gas which particles should be separated from said flue gas. To date, this problem has not been solved. For thermodynamic reasons, very high temperatures are required for the gas flowing into the gas turbine of the plant. This, however, prohibits the use of conventional flue gas-dust filters such as cloth filters and electro-filters. Consequently, only those separators of the cyclone type are available. However, these cyclone type separators are also unsatisfactory because of the high viscosity of the hot flue gases. Further, any particles which are not deposited in the cyclone separators may arrive in the gas turbine where they become deposited and cause wear on the turbine. Still further, if the deposits appear on the rotor of the gas turbine, a dangereous unbalance may occur which necessitates premature stoppage and cleaning of the plant.

Accordingly, it is an object of the invention to remove or separate suspended particles from a flue gas in a relatively simple and efficient manner within a gas turbine-steam power plant.

It is another object of the invention to reduce the risk of deposits occurring in a gas turbine of a gas turbine-steam power plant utilizing a fluidized bed combustion chamber.

It is another object of the invention to reduce the amount of maintenance required for a gas turbine-steam power plant.

Briefly, the invention is directed to a gas turbine-steam power plant which is comprised of a compressor for compressing a flow of combustion air, a pressure vessel having a combustion chamber for receiving the compressed air and a gas turbine for receiving a heated flow of gas from the pressure vessel.

In accordance with the invention, a recuperator is positioned within the pressure vessel for removing heat from a flow of hot gas passing from the combustion chamber on a primary side thereof. In addition, a heat exchanger is disposed within the pressure vessel downstream of the recuperator relative to the flow of hot gas for removing heat from the gas. Further, separating means are disposed downstream of the heat exchanger relative to the flow of gas for removing particles from the gas. The separating means includes an outlet which is connected to a secondary side of the recuperator in order to deliver the flow of gas thereto for heating purposes while an outlet of the secondary side of the recuperator is connected with an inlet to the gas turbine in order to deliver the heated flow of gas to the gas turbine.

The construction of the power plant permits the use of a better separating means, such as one which requires a relatively low operating temperature for physical and/or technical reasons. Further, the layout of the plant is simpler not only with respect to construction details but also with respect to mechanical details.

In one embodiment, the separating means may be in the form of an electrostatic flue gas filter. This has the advantage that the pressure drop in the separating means is very small and practically constant in operation. In contrast to cloth filters, the flow cross-sections in electro-static filters are practically independent of the amount of deposited particles.

The separating means may also be disposed in the pressure vessel. This permits operation without additional connecting lines and additional supporting means.

A coarse separating means may also be disposed in the pressure vessel between the combustion chamber and the recuperator in order to remove coarse particles from the flow of hot gas. Such a separating means may be of the cyclone type. This permits a preliminary purification of the flue gas and relieves the separating means between the combustion chamber and the recuperator.

An air heater may also be disposed within the combustion chamber with connections to the compressor and turbine in order to heat a second flow of air from the compressor.

Further, the power plant has a steam generator which is connected to an outlet of the gas turbine for receiving a flow of hot gas therefrom. This steam generator includes a plurality of heating surfaces for conducting a working medium in heat exchange relation with the flow of hot gas from the turbine and at least one of these heating surfaces is connected with the heat exchanger in the pressure vessel in order to convey working medium therethrough. This construction reduces not only the fuel losses but also simultaneously reduces the amount of combustion residues to be deposited.

Figure 2:
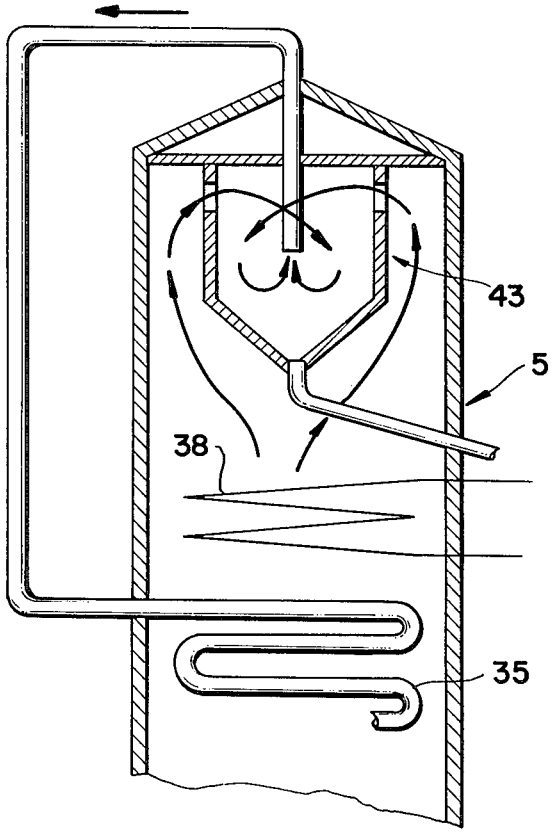

These and other objects and advantages of the invention will become more apparent from the following detailed description taken in conjunction with the accompanying drawings in which:

FIG. 1 schematically illustrates a gas turbine-steam power plant constructed in accordance with the invention; and FIG. 2 illustrates a part cross-sectional view of a separating means disposed in a pressure vessel in accordance with the invention.

Referring to FIG. 1, the gas turbine-steam power plant includes a gas turbine group 1 consisting of a compressor 2, a gas turbine 3 and a generator 4. The gas turbine group 1 also has a pressure vessel 5 which functions as the combustion chamber for the gas turbine group 1. In addition, the plant has an exhaust steam generator 6 which is connected with a steam turbine 7 which, in turn, is connected with an electric generator 8.

As indicated, the compressor 2 serves to compress a flow of combustion gas which passes therethrough from a suitable source.

The pressure vessel 5 is disposed on a vertical axis and has an air distribution box 13 for receiving a flow of compressed air from the compressor 2. The distribution box 13 is terminated at the top by a pervious bottom 14 above and downstream of which a combustion chamber 15 is disposed for the formation of a fluidized combustion bed 18. The fluidized bed 18 consists of inert grains as well as of lime and coal grains which are carried by an air current rising from the air distribution box 13. The lime and coal grains, just as the inert grains which must be occassionally replenished because of wear, are introduced through a lateral feeding means 20 into the fluidized bed 18.

As shown, a heating surface 22 is disposed in the combustion bed 18 and is traversed by a working medium from the exhaust steam generator 6. In addition, an air heater 23 is disposed within the fluidized bed 18 and is traversed by compressed air.

A coarse separating means in the form of a pair of cyclones 25, each of which has a lateral flue gas inlet 26 and a central outlet pipe 27, is located in the combustion chamber 15 above the fluidized bed 18. The outlet pipes 27 pass through a bottom 30 which separates the combustion chamber 15 from a flue 33 which is arranged in the pressure vessel 5. This flue 33 is provided with a recuperator 35 and a heat exchanger 38 downstream of the recuperator 35.

The upper end of the flue 33 communicates via a line 41 with an inlet 42 of a separating means in the form of a dust separator 43. This separator 43 has a cylindrical pressure vessel 44 with a vertical axis and a bottom in the form of a funnel 40. The inlet 42 is arranged close to the upper end of the vessel 44 and extends in a tangential direction. An immersion tube 45 is arranged in the center of the vessel 44 and extends into a lower region of the separator 43 to receive purified flue gas from the separator 43. As shown, the immersion tube 45 is surrounded by a filter bag 46 which is tightly connected at the upper end with a cover of the pressure vessel 44. Closing means (not shown) are provided on the funnel 40 through which substances deposited on the filter bag 46 and accumulating in the funnel 40 can be discharged. A connecting line 50 also leads from the immersion tube 45 to the secondary side of the recuperator 35.

As indicated, the gas turbine 3 has an inlet which is connected to the secondary side of the recuperator 35 via a line 60 in order to receive a heated flow of gas therefrom. In addition, a line 62 connects the compressor 2 to the distribution box 13 while a branch line 63 from the line 62 connects over a throttle 64 with an inlet of the air heater 23. Further, an outlet of the air heater 23 opens into the line 60 and thus leads into the gas turbine 3.

The exhaust steam generator 6 operates on two pressure stages of the working medium and has a low pressure drum 70 and a high pressure drum 72. The steam generator 6 is connected with an outlet of the gas turbine 3 via a line 76 for receiving a flow of exhaust or expanded gas and includes a plurality of heating surfaces for conducting the working medium in heat exchange relation with the exhaust gas from the turbine 3. Most of the heating surfaces of the steam generator 6 are arranged in an exhaust gas flue 75 which communicates directly with the line 76. Taken in the direction of flow of the exhaust gases, the heating surfaces include a high pressure superheater 78, a high pressure pre-evaporator 79, a high pressure feed water preheater 80, a low pressure superheater 82 and a low pressure evaporator 83.

The steam turbine 7 has an outlet which is connected to a condenser 86 and, via a condensate line 87 with a low pressure pump 88 to the low pressure drum 70. As indicated, the low pressure evaporator 83 is connected at both ends to the low pressure drum 70. In addition, a saturated steam pipe 90 leads from the low pressure drum 70 to the low pressure superheater 82 which, in turn, is connected via a low pressure inlet 92 with the steam turbine 7.

A water pipe 94 leads from the low pressure drum 70 via a high pressure pump 95 to the high pressure preheater 80 and thence to the high pressure drum 72. A line 96 in which a recirculating pump 97 is disposed leads over the high pressure pre-evaporator 79, heating surface 22 in the pressure vessel 5 and heat exchanger 38 back to the high pressure drum 72. The heating surface 22 thus acts as an evaporator heating surface. A line 98 is also connected to the steam compartment of the high pressure drum 72 to carry saturated steam to the high pressure superheater 78. This superheater 78 is, in turn, connected over a live steam pipe 99 with a high pressure inlet of the steam turbine 7.

The operation of the plant is as follows.

The gas turbine group 1 is started by the generator 4. In this case, the generator 4 operates as a motor. Air is then compressed in the air compressor 2 and delivered partly over the line 62 to the air distribution box 13 and partly to the line 63 via the throttle 64. The air flow which passes into the distribution box is then distributed into the fluidized bed 18 into wich lime and coal grains have been introduced over the feeding means 20. The fuel grains together with grains of an inert substance such as slag or sand are then caused to move in a turbulent manner. As such, the fluid bed 18 has a practically uniform temperature of about 900° C. so that the coal burns. The resulting flue gas, likewise of 900° C., with a slight excess of air, flows through the coarse separating means 25. The coarser particles which are carried along from the fluid bed 18 are then deposited in the separating means 25 and flow back into the fluid bed in a manner not shown.

The flue gas which has been pre-purified continues through the flue 33 and gives off heat to the recuperator 35 and heat exchanger 38. Between the recuperator 35 and the heat exchanger 38, the flue gas has a temperature of, for example, 550° C. This temperature is further reduced to 500° C. upon passing through the heat exchanger 38. This temperature value is still admissable for the filter bag 46 of the dust separator 43 following in the flue gas flow.

Upon passage of the hot gas through the seperator 43, the fine ash and slag particles of the flue gas are retained in the filter bag 46. A suitable device (not shown) can be used to set the filter bag 46 into periodic vibration so that the filter cake deposited on the fabric is detached and dropped into the funnel 40 from where the separated material can be periodically discharged. The purified flue gas is then fed through the line 50 to the recuperator 35.

The purified gas passing through the secondary side of the recuperator 35 is heated by about the same temperature interval by which it had first been cooled on the primary side. Thus, the flue gas leaves the recuperator 35 with a temperature of about 850° C. and flows through the line 60 into the gas turbine 3.

The second part of the air passing from the compressor 2 passes through the air heater 23 and arrives in the gas turbine 3. This flow of air is likewise heated in the air heater 23 to about 850° C. so that the turbine 3 receives a gas mixture of practically uniform temperature.

After expansion in the gas turbine 3, the gas flows through the exhaust pipe 76 into the steam generator 6 where heat is given off to the heating surfaces 78, 79, 80, 82.

It is to be noted that the amount of air conducted over the air heater 23 is about twice the amount of gas conducted through the fluidized bed 18. Further, the recuperator 35 has about triple the surface of the air heater 23 to attain the indicated temperature. By increasing the size of the recuperator 35 and the heat exchanger 38 and/or by lowering the live steam pressure of the high pressure steam leaving the steam generator 6, it is possible to futher reduce the temperature ahead of the separator 43.

On the steam generator side, condensate is fed into the low pressure drum 70 from the condenser 86 via the low pressure pump 88. In natural circulation, water flows from the low pressure drum 70 in the evaporator 83 and then as a water-steam mixture back into the drum 70. From the saturated steam compartment of this drum, steam flows into the low pressure superheater 82 and then, in a superheated state to the low pressure inlet 92 of the steam turbine 7. Water is pumped by means of the high pressure pump 95 from the low pressure drum 70 over the feed water preheater 80 into the high pressure drum 72. The recirculating pump 97 feeds water from the drum 72 over the high pressure pre-evaporator 79 in which little or no steam is yet generated, into the heating surface 22 and heat exchanger 38. As a water-steam mixture, the working medium then arrives in the high pressure drum 72. The high pressure steam separated in the drum 72 flows into the high pressure superheater 78 and arrives via the live steam line 99 in the steam turbine 7.

The reduction of the flue gas temperature achieved by the recuperator 35 and heat exchanger 38 permits the purification of the flue gases with more effective separating means than before. If electrostatic filters are used as the dust separators, it may be advisable to polarize their ionizing electrodes relative to the mass of the recuperator 35 in such a way that the charged fine particles which have passed through the separator are not deposited on the inner walls of the recuperator 35 but repelled by the recuperator 35.

The wall of the pressure vessel 5 can be formed, for example of tightly welded tubes in which water flows from the exhaust gas generator in order to cool the walls. However, the walls may also be protected against an excessive temperature by a special insert formed of cooling pipes.

For thermodynamic reasons, a possible large portion of the heat released in the pressure vessel 5 may be transferred to the gas current fed to the gas turbine 3, for example by reducing or eliminating the size of the heating surface 22 and/or by protecting the cooled walls of the pressure vessel 5 against large heat absorption by lining the walls with fire clay.

Instead of recycling the particles removed by the coarse separator 25 via the feeding means 20, the particles may also be returned into the fluidized bed 18 by a siphon-type means (not shown).

Referring to FIG. 2, wherein like reference characters indicate like parts as above, the dust separator 43 may be disposed inside the pressure vessel 5. This permits operation without additional connecting lines and additional supporting means.

Of note, in case the flue gas heated in the recuperator 35 does not have the same temperature as the air current heated in the air heater 23, mixing means, such as static mixers, can be arranged at the junction of the two gas currents or between this point and the gas turbine 3.

The invention thus provides a gas turbine-steam power plant which can be operated with reduced maintenance since the gas particles suspended in the flue gas stream can be more effectively removed.

What is claimed is:

1. A gas turbine-steam power plant comprising a compressor for compressing a flow of combustion air passing therethrough;

a gas turbine;

a pressure vessel having an air distribution box for receiving a flow of compressed air from said compressor and a combustion chamber for a fluidized combustion bed downstream of said distribution box;

a separating means in the flow of gas between said combustion chamber and said gas turbine;

an exhaust steam generator connected to said gas turbine to receive a flow of expanded gas therefrom;

an evaporator-heating surface disposed within said combustion chamber for conveying a working medium therethrough in heat exchange relation with the flow of gas;

a recuperator disposed in the flow of gas between said combustion chamber and said separating means, said recuperator having an inlet to receive a flow of gas from said separating means and an outlet connected to said turbine to deliver a flow of gas to said turbine; and a heat exchanger disposed in the flow of gas between said recuperator and said separating means for removing heat from the flow of flue gas passing to said separating means.

2. The combination as set forth in claim 1 wherein said separating means is an electrostatic flue gas filter.

3. The combination as set forth in claim 1 wherein said separating means is disposed in said pressure vessel.

4. The combination as set forth in claim 1 which further comprises a coarse separating means in said pressure vessel between said combustion chamber and said recuperator for removing coarse particles from the flow of hot gas.

5. The combination as set forth in claim 1 which further comprises an air heater within said combustion chamber and connected between said compressor and said turbine for heating of a second flow of air from said compressor.

6. The combination as set forth in claim 1 wherein said steam generator includes a plurality of heating surfaces for conducting a working medium in heat exchange relation with the flow of expanded gas from said turbine, at least one of said heating surfaces being connected with said heat exchanger to convey working medium therethrough.

7. In a gas turbine steam power plant, the combination comprising a compressor for compressing a flow of combustion air passing therethrough;

a pressure vessel having a combustion chamber for receiving a flow of compressed air from said compressor;

a recuperator within said pressure vessel for removing heat from a flow of hot gas from said combustion chamber on a primary side thereof;

a heat exchanger within said pressure vessel downstream of said recuperator relative to the flow of hot gas for removing heat from the flow of gas;

separating means downstream of said heat exchanger relative to the flow of gas for removing particles from the flow of gas, said separating means having an outlet in communication with a secondary side of said recuperator to deliver the flow of gas thereto for heating therein; and a gas turbine having an inlet connected to said secondary side of said recuperator to receive a heated flow of gas therefrom.

8. The combination as set forth in claim 7 wherein said separating means is an electrostatic flue gas filter.

9. The combination as set forth in claim 7 wherein said separating means is disposed in said pressure vessel.

10. The combination as set forth in claim 7 which further comprises a coarse separating means in said pressure vessel between said combustion chamber and said recuperator for removing coarse particles from the flow of hot gas.

11. The combination as set forth in claim 7 which further comprises an air heater within said combustion chamber and connected between said compressor and said turbine for heating of a second flow of air from said compressor.

12. The combination as set forth in claim 7 which further comprises a steam generator connected to an outlet of said gas turbine for receiving a flow of expanded gas therefrom, said steam generator including a plurality of heating surfaces for conducting a working medium in heat exchange relation with the flow of expanded gas from said turbine, at least one of said heating surfaces being connected with said heat exchanger to convey working medium therethrough.

* * * * *